US007792441B2

(12) United States Patent
Akatsu et al.

(10) Patent No.: US 7,792,441 B2
(45) Date of Patent: Sep. 7, 2010

(54) IMAGE FORMATION APPARATUS

(75) Inventors: Shinichi Akatsu, Tokyo (JP); Takashi Suzuki, Tokyo (JP); Tsutomu Nakagawa, Tokyo (JP); Shigeru Tosa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 588 days.

(21) Appl. No.: 11/766,352

(22) Filed: Jun. 21, 2007

(65) Prior Publication Data

US 2008/0019718 A1 Jan. 24, 2008

(30) Foreign Application Priority Data

Jul. 24, 2006 (JP) ..... 2006-201306

(51) Int. Cl.
*G03G 15/00* (2006.01)

(52) U.S. Cl. ..... 399/49; 399/46; 399/60; 399/66; 399/301

(58) Field of Classification Search ..... 399/46, 399/49, 60, 66, 301
See application file for complete search history.

(56) References Cited

U.S. PATENT DOCUMENTS

| | | | | |
|---|---|---|---|---|
| 4,277,162 | A * | 7/1981 | Kasahara et al. | 399/49 |
| 5,294,959 | A * | 3/1994 | Nagao et al. | 399/66 |
| 5,296,903 | A * | 3/1994 | Suzuki et al. | 399/66 |
| 5,978,615 | A * | 11/1999 | Tanaka et al. | 399/49 |
| 6,243,542 | B1 | 6/2001 | Fujimoto et al. | |
| 6,556,229 | B2 | 4/2003 | Mitsuya et al. | |
| 6,684,036 | B2 | 1/2004 | Kubota et al. | |
| 6,738,586 | B2 | 5/2004 | Kubota et al. | |
| 2005/0105926 | A1 | 5/2005 | Akatsu et al. | |
| 2006/0285864 | A1 * | 12/2006 | Hattori | 399/49 |

FOREIGN PATENT DOCUMENTS

| | | |
|---|---|---|
| JP | 5-333652 | 2/1993 |
| JP | 2000-184158 | 6/2000 |
| JP | 2004-29217 | 1/2004 |
| JP | 2005-77502 | 3/2005 |

* cited by examiner

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

An image formation apparatus is disclosed. The image formation apparatus includes a transfer effectiveness detector that further includes a computing unit for converting a sensor output voltage into a toner adhesion amount, and a transfer effectiveness detecting unit for obtaining transfer effectiveness by comparing a toner adhesion amount Td on a photo conductor with a toner adhesion amount Tb on a middle transfer object. Here, the toner adhesion amount Td is obtained by the computing unit converting an output of a photo conductor image detection unit, and the toner adhesion amount Tb is obtained by the computing unit converting an output of a middle transfer object image detection unit. When the transfer effectiveness detection unit determines that an abnormality is present in the transfer, whether the abnormality is due to decreased development capacity or due to decreased transfer effectiveness can be determined. If it is determined that the transfer effectiveness is less than a threshold value, a printing operation of the image formation apparatus is stopped given that the transfer effectiveness compensation is not possible.

3 Claims, 7 Drawing Sheets

IMAGE FORMATION APPARATUS

BACKGROUND OF THE INVENTION

1. Field of the Invention

The present invention generally relates to an image formation apparatus such as a plotter, and a multifunction machine capable of at least two functions out of copying, printing, and facsimile operations, and especially relates to an image formation apparatus that reads an image formed under predetermined conditions by an optical reflection type density sensor, wherein image formation conditions are adjusted according to an output value of the density sensor.

2. Description of the Related Art

Recently and continuing, documents are often required to be in colors, and swift processing is required. Accordingly, laser beam printers are made capable of color printing and high-speed printing.

For example, a color electronic photography apparatus of a tandem system for forming a color image is known, wherein toners in yellow (Y), cyan (C), magenta (M), and black (K) colors are used. The apparatus includes image formation units for the colors for forming toner images in the colors, wherein the toner images are superposed on a middle transfer object so that a color image is obtained.

Generally, according to the electronic photography apparatus of the tandem system, the toner images in different colors are independently formed by two or more image formation units one by one on corresponding photo conductors, and the toner images on the photo conductors are superposed on the middle transfer object.

Conventionally, in order to make uniform the density of images, a density patch (test image) is formed on the photo conductor and the middle transfer object under predetermined conditions, an amount of toner adhering (toner adhesion amount) to the density patch is detected by an optical reflection type density sensor, and toner adhesion amount control is performed so that the image formation conditions are adjusted. The image formation conditions include parameters about toner supply to a development unit, electrification potential, development bias potential, and exposure potential.

As disclosed by Patent Reference 1, it is known that the image formation conditions can be more accurately controlled based on the toner adhesion amount of an output image after fixing, rather than based on the toner adhesion amount of the density patch formed on the photo conductor and the middle transfer object.

[Patent Reference 1] JPA 2000-184158

[Patent Reference 2] JPA 2005-077502

[Patent Reference 3] JPA 2004-029217

[Patent Reference 4] JPA H05-333652

DISCLOSURE OF INVENTION

[Objective of Invention]

However, the toner adhesion amount after fixing is subject to primary transfer effectiveness (transfer from the photo conductor to the middle transfer object), and secondary transfer effectiveness (from the middle transfer object to a final image supporting object such as paper). For this reason, change of development capacity of the toner cannot be accurately detected.

In the case where the primary transfer effectiveness and the secondary transfer effectiveness are remarkably small, if the image formation conditions are adjusted by detecting the toner adhesion amount after transferring, the image formation conditions require a greater amount of toner than usual on the photo conductor, that is, toner consumption is increased.

Further, since the greater amount of the toner has to be developed, a greater potential difference for development tends to be provided, which requires that charging potential be greater than usual, increasing the burden on the photo conductor, and posing a problem in that, e.g., the service life of the photo conductor is reduced.

Further, in order to maintain the toner adhesion amount on the paper within a predetermined range, the toner adhesion amount on the photo conductor has to be maintained within a corresponding predetermined range by controlling the image formation conditions.

Factors that cause fluctuation of the toner adhesion amount include a change of development capacity with time, which change can be rectified by control, an error of the development capacity due to a mechanical deviation, which error cannot be corrected by control, a control error, and a detection error caused by the image detection unit. The total of the factors described above has to be within a range such that the toner adhesion amount on the photo conductor may be maintained within the predetermined range.

When controlling the image formation conditions by detecting the toner adhesion amount, for example, on the middle transfer object after the primary transfer, a detection error in consideration of the primary transfer effectiveness has to be included in the amount fluctuation factors of toner adhesion. In this case, an allowance (tolerance) to the fluctuation factors other than the detection error becomes small.

SUMMARY OF THE INVENTION

The present invention provides an image formation apparatus that substantially obviates one or more of the problems caused by the limitations and disadvantages of the related art.

The present invention provides an image formation apparatus that is capable of delivering an output image wherein the toner adhesion amount on a recording medium is stabilized while reducing toner consumption.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by an image formation apparatus particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides an image formation apparatus that includes:

a plurality of image formation units for forming toner images in different colors on corresponding image supporting objects;

a middle transfer object, to which the toner images in different colors formed on the image supporting objects of the image formation units are transferred one by one;

an image detection unit that includes a luminous source for irradiating a light onto a position where the toner image passes, and an optical receiving unit for receiving the light that is reflected by the toner image; and a control unit for controlling image formation conditions based on a detection result of the image detection unit;

wherein the image detection unit includes an image supporting object image detection unit that is arranged countering each of the image supporting objects of the image formation units, and a middle transfer object image detection unit that is arranged countering the middle transfer object, and the image formation unit includes a transfer effectiveness detection unit for detecting transfer effectiveness between the image supporting object and the middle transfer object by detecting a difference between a toner adhesion amount of a toner image of a color detected by the image supporting object image detection unit and a toner adhesion amount of the toner image (that has been transferred from the image supporting object to the middle transfer object) in the same color detected by the middle transfer object image detection unit for all the colors.

According another aspect of the embodiment, the image formation apparatus further includes an image detection switching unit for switching between the image supporting object image detection unit and the middle transfer object image detection unit.

According to another aspect of the embodiment, the image supporting object image detection unit and the middle transfer object image detection unit of the image formation apparatus are arranged at the same location in a main scanning direction.

According to another aspect of the embodiment, a printing operation of the image formation apparatus is stopped when the transfer effectiveness detected by the transfer effectiveness detection unit is different from target transfer effectiveness (out of a predetermined target range).

According to another aspect of the embodiment, the image detection switching unit of the image formation apparatus selects the image supporting object image detection unit when controlling image formation conditions, and selects the middle transfer object image detection unit during printing for detecting the toner adhesion amount of the toner image.

[Effectiveness Of Invention]

According to the present invention, under conditions wherein the transfer effectiveness is remarkably decreased, the burden on the photo conductor (image supporting object) is mitigated, an image is formed on the photo conductor with a stabilized toner adhesion amount, and toner consumption is reduced by detecting the transfer effectiveness and stopping an operation of the image formation apparatus.

DESCRIPTION OF THE PREFERRED EMBODIMENTS

In the following, embodiments of the present invention are described with reference to the accompanying drawings.

Figure 1:
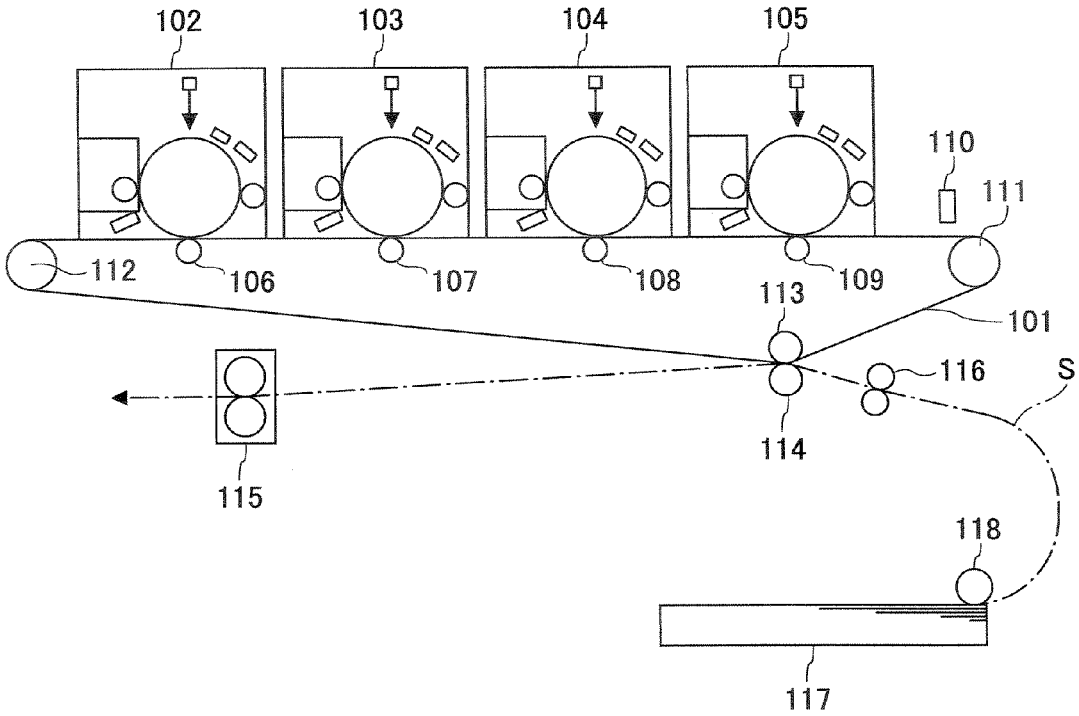
FIG. 1 is a schematic diagram of an image formation apparatus according to an embodiment the present invention.

FIG. 1 shows the outline configuration of an image formation apparatus according to the embodiment of the present invention. With reference to FIG. 1, the image formation apparatus includes a middle transfer belt 101 serving as a middle transfer object, a first image formation unit 102, a second image formation unit 103, a third image formation unit 104, a fourth image formation unit 105, primary transfer rollers 106 through 109 serving as a primary transfer unit, a middle transfer object image detection unit 110 (that is an optical reflection type density sensor including a luminous source and an optical receiving unit), belt support rollers 111 through 113, a secondary transfer roller 114 serving as a secondary transfer unit (the support roller 113 may serve as the secondary transfer roller), a recording medium such as Paper S serving as a final image supporting object, a fixing unit 115, a resist roller pair 116, a feed cassette 117, and a feed roller 118.

Figure 2:
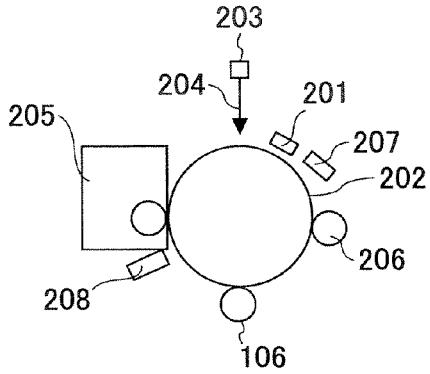
FIG. 2 is a schematic diagram of an image detection unit of a photo conductor according to the embodiment the present invention.

The image formation unit 102 includes the following items as shown in FIG. 2, namely, a photo conductor 202 serving as an image supporting object, a charging unit 201 for electrifying (charging) the photo conductor 202, an exposing unit 203, a laser light 204 irradiated by the exposing unit 203, a developing unit 205, a photo conductor cleaner 206, an eraser 207, and a photo conductor image detection unit 208 (optical reflection type density sensor including a luminous source and an optical receiving unit). The image formation units 103 through 105 are configured the same as the image formation unit 102.

Image formation operations performed by the image formation unit 102 are described. First, the charging unit 201 uniformly electrifies the photo conductor 202. Then, the exposing unit 203 irradiates the laser light to the photo conductor 202 according to image data, a discharge potential is provided by the laser light, and a latent image is formed.

Then, the latent image formed on the photo conductor 202 is developed with a toner by the developing unit 205 between a development potential and the discharge potential, and a toner image is formed. Next, the toner image formed on the photo conductor 202 is transferred to the middle transfer belt 101 with the primary transfer roller 106. Then, the eraser 207 uniformly irradiates a light onto the photo conductor 202 such that all electric charges of the photo conductor 202 are discharged.

Operations of the image formation units 103 through 105 are the same as described above, but color of the toner is different. That is, toner images in respective colors are similarly formed on the corresponding photo conductors 202. The toner images are transferred to the middle transfer belt 101 with the primary transfer rollers 107 through 109 so that all the toner images in different colors are superposed. The superposed toner images now constitute a color image, and the color image is transferred from the middle transfer belt 101 to Paper S with the secondary transfer roller 114. The color image is fixed by the fixing unit 115, and a series of printing processes is completed.

Residual toner that remains on the photo conductor 202 without being transferred to the middle transfer belt 101 is recovered by the photo conductor cleaner 206.

Next, with reference to FIG. 3 through FIG. 7, descriptions follow about toner adhesion amount control whereby image formation conditions are controlled such that the toner adhesion amount detected by the middle transfer object image detection unit 110 on Paper S may be within a predetermined range.

Figure 3:
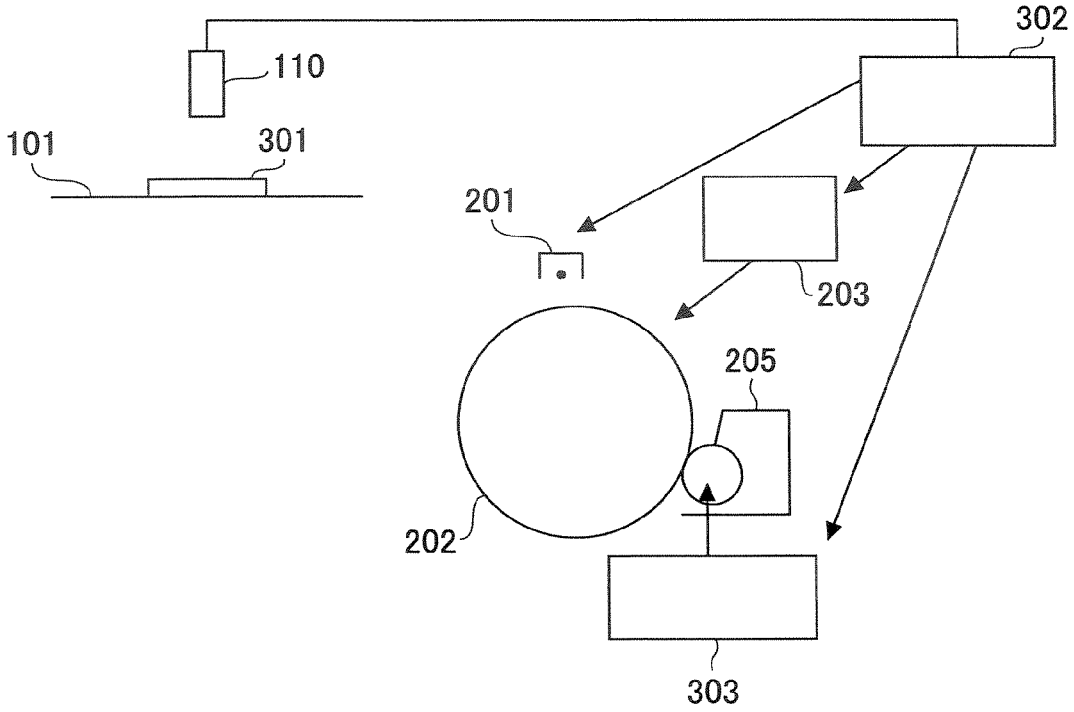
FIG. 3 is a schematic diagram of a first toner adhesion amount control unit.
Figure 4:
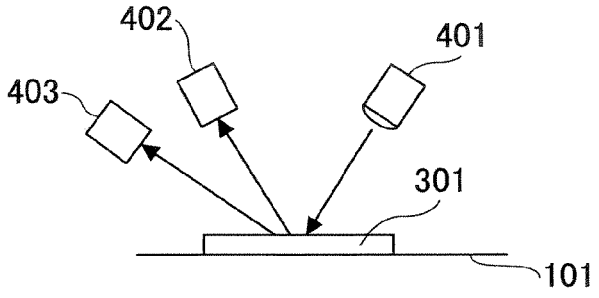
FIG. 4 is a schematic diagram of an image detection unit of a middle transfer belt.

FIG. 3 shows the configuration of a first toner adhesion amount control unit, and FIG. 4 shows the configuration of the middle transfer object image detection unit 110.

With reference to FIG. 3, a density patch 301 formed on the middle transfer belt 101 is detected by the middle transfer object image detection unit 110 that includes a luminous source 401 for irradiating a light, an optical receiving unit A 402 and an optical receiving unit B 403 as shown in FIG. 4.

The light is irradiated by the luminous source 401 to the density patch 301 on the middle transfer belt 101. The light reflected by the density patch 301 is received by the optical receiving units A and B, 402 and 403, respectively; and output voltages corresponding to the toner adhesion amount of the density patch 301 are obtained. The output voltages provided by the middle transfer object image detection unit 110 are converted into a toner adhesion amount of the density patch 301 by a computing unit 302 (described below). Then, the image formation conditions are adjusted so that the toner adhesion amount may be equal to a target amount. Here, the image formation conditions include the electrification potential of the charging unit 201, an exposure amount 204 of the exposing unit 203, and a development bias potential of a biasing unit 303.

Hereafter, factors that cause fluctuation of the toner adhesion amount on Paper S are described. The factors include degradation of a developer, decline of transfer effectiveness, and degradation of development capacity due to an environmental change. First, the adhesion amount control at the time of the degradation of the development capacity is described.

Figure 5:
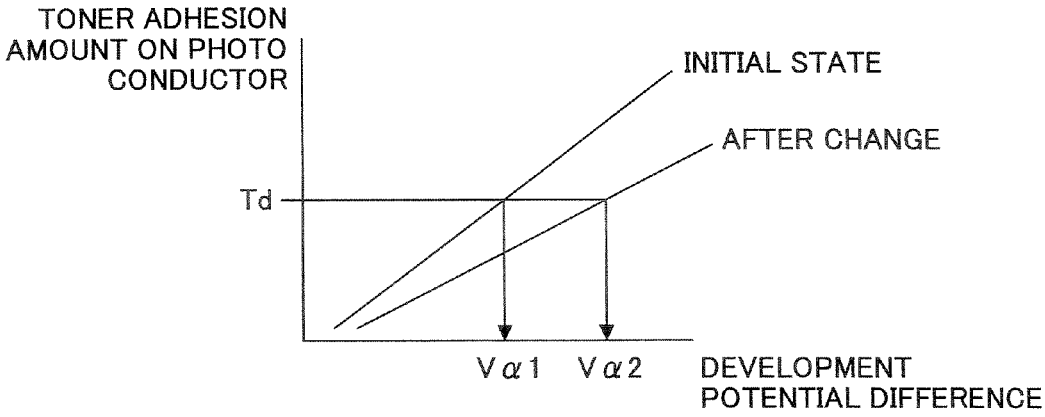
FIG. 5 is a graph for explaining the first toner adhesion amount control.

The toner adhesion amount control is described with reference to FIG. 5. The horizontal axis represents a development potential difference, which is a difference between the development bias potential and a residual potential. The vertical axis represents the toner adhesion amount on the photo conductor 202. An upper of two lines in FIG. 5 represents initial development capacity, and the other, that is, a lower line represents degraded development capacity when the developer is degraded with the time and environments.

When the toner adhesion amount control is to adjust the toner adhesion amount on the photo conductor 202 to Td as a control target, a required development potential difference is Vα1 in the case wherein the developer has the initial development capacity.

In the case wherein the development capacity is degraded, a development potential difference Vα2 is required to obtain the control target Td, which Vα2 is greater than Vα1. That is, a greater development potential difference is required, and for this reason, a greater electrification potential is required for the photo conductor 202.

Although the relationship is Vα1<Vα2 in this description, the relationship may become Vα1>Vα2 if the development capacity becomes high because the toner density becomes high.

Next, the adhesion amount control at the time of the decline of the transfer effectiveness is described.

Figure 6:
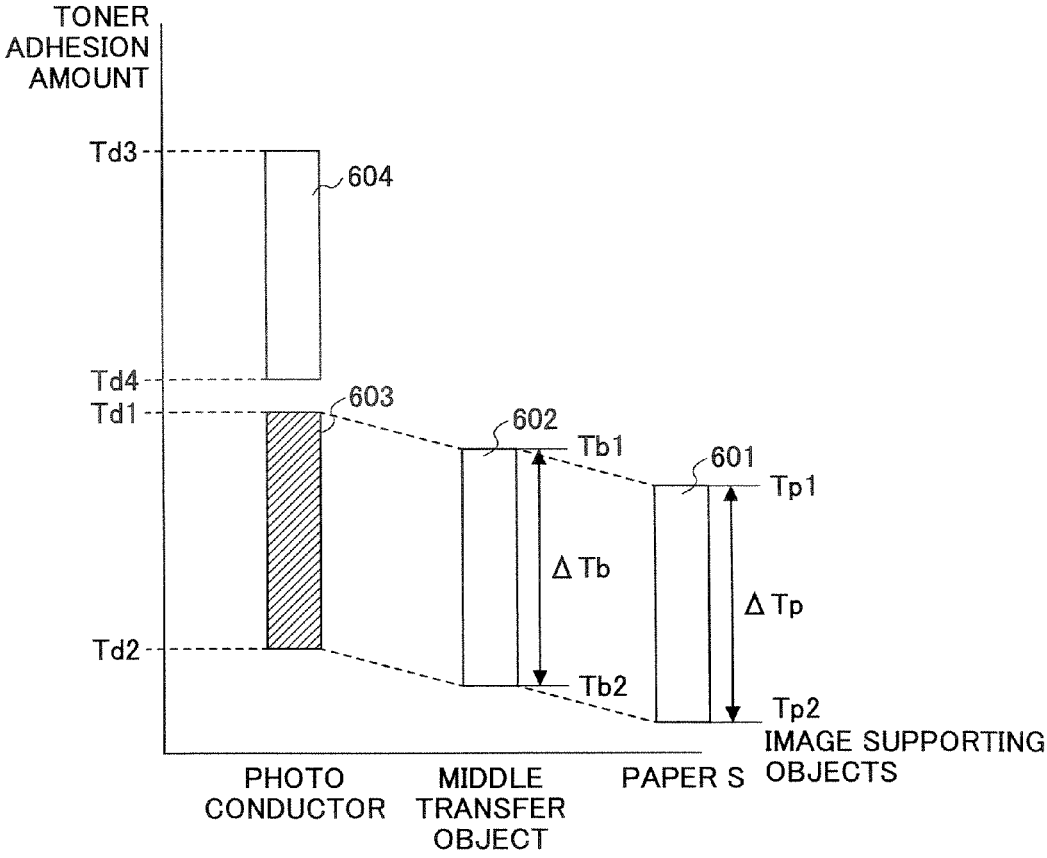
FIG. 6 is a graph showing toner adhesion amounts on image supporting objects according to the first toner adhesion amount control.

FIG. 6 shows relationships of toner adhesion amounts of the density patch 301 formed on image supporting objects at various stages with reference to a target toner adhesion amount of the output image.

Here, the image supporting objects are the photo conductor 202, the middle transfer belt 101, and Paper S. We suppose that the toner adhesion amount on Paper S is desired to be within a range 601. Then, the toner adhesion amount on the middle transfer belt 101 is allowed to take a range 602; and the toner adhesion amount on the photo conductor 202 is allowed to take a range 603 under a given transfer effectiveness. The toner adhesion amount on the photo conductor 202 is required to take a range 604 when the transfer effectiveness becomes less than the given transfer effectiveness.

The range 601 of the toner adhesion amount on Paper S is expressed by ΔTp=Tp1~Tp2. The range 602 of the toner adhesion amount on the middle transfer belt 101 is expressed by ΔTb=Tb1~Tb2. The range 603 of the toner adhesion amount on the photo conductor is expressed by ΔTd=Td1~Td2. Further, normal primary transfer effectiveness (transfer from the photo conductor 202 to the middle transfer belt 101) is defined to range between maximum γ1MAX<=1 and minimum γ1min<=1; and the secondary transfer effectiveness (transfer from the middle transfer belt 101 to Paper S) is defined to range between maximum γ2MAX<=1 and minimum γ2min<=1.

In order for the range 601 of the toner adhesion amount on Paper S to be within the range ΔTp, Tp1 and Tp2 have to suffice for the following conditions.

Tp1 and Tp2 that define the range ΔTp are expressed as follows.

$$Tp1=(Td1\times\gamma1\mathrm{MAX})\times\gamma2\mathrm{MAX}$$

$$Tp2=(Td2\times\gamma1\mathrm{min})\times\gamma2\mathrm{min}$$

That is, the range 603 of the toner adhesion amount on the photo conductor 202 has to be between Td1 and Td2 expressed as follows.

That is, Td1 and Td2 that define the range ΔTd are expressed as follows.

$$Td1=Tp1/(\gamma1\ \mathrm{MAX}\times\gamma2\mathrm{MAX})$$

$$Td2=Tp2/(\gamma1\ \mathrm{min}\times\gamma2\mathrm{min})$$

The above is true so long as the primary transfer effectiveness and the secondary transfer effectiveness stay within the respective ranges.

If the primary transfer effectiveness is remarkably decreased to be between γ0MAX<=1 and γ0min<=1, where γ1MAX>γ0MAX, and γ1min>γ0min, a greater adhesion amount, ranging between Td3 and Td4, is required. The relationships now are:

$$Tp1=(Td3\times\gamma0\mathrm{MAX})\times\gamma2\mathrm{MAX}$$

$$Tp2=(Td4\times\gamma0\mathrm{min})\times\gamma2\mathrm{min}$$

That is, the range 604 of the tone adhesion amount on the photo conductor 202 has to range between Td3 and Td4 as follows.

$$Td3=Tp1/(\gamma0\mathrm{MAX}\times\gamma2\mathrm{MAX})$$

$$Td4=Tp2/(\gamma0\mathrm{min}\times\gamma2\mathrm{min})$$

Accordingly, Td1>Td3 and Td2>Td4; that is, a greater amount of toner has to be developed, which requires a greater development potential difference, which, in turn, requires a greater electrification potential. This increases the burden on the photo conductor 202, its service life is shortened, and toner consumption is increased.

As described above, according to the toner adhesion amount control, the development potential difference is increased when the development capacity and the transfer effectiveness are decreased, which results in shortening the service life of the photo conductor 202. In order to reduce the burden of the photo conductor 202, the development potential difference is desired to be small as much as possible.

If a superfluous development potential difference is required, it is due to a remarkable decrease of the development capacity and the transfer effectiveness; this abnormal situation can be detected based on the development capacity.

Figure 7:
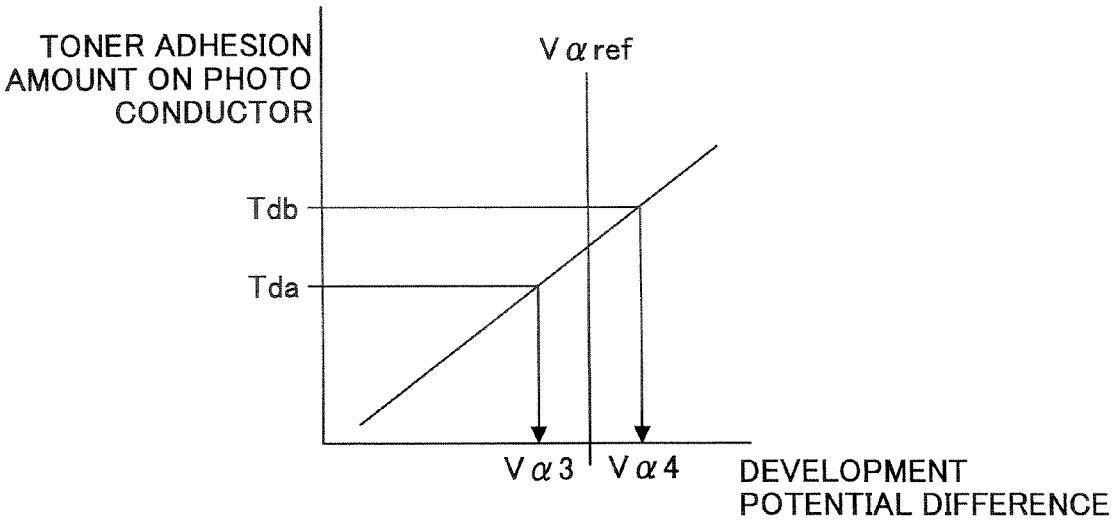
FIG. 7 is a graph for explaining the second toner adhesion amount control.

FIG. 7 is a graph showing relationships between the toner adhesion amount on the photo conductor 202 and a transfer effectiveness fluctuation. An abnormal state detection is described with reference to FIG. 7, wherein the horizontal axis represents the development potential difference, and the vertical axis represents the toner adhesion amount on the photo conductor 202.

At a given transfer effectiveness, a development potential difference Vα3 provides a toner adhesion amount Tda, where the Tda=(Td1−Td2)/2; that is, Tda is a median value of the range 603 that is defined by Td1 and Td2 at a given development capacity.

If the transfer effectiveness is decreased, the toner adhesion amount on the photo conductor 202 has to be adjusted to be in the range 604 that is defined by Td3 and Td4, the median value of which range 604 is Tdb=(Td3−Td4)/2. A development potential difference Vα4 is required to obtain the median value Tdb at the given development capacity.

Here, it is conceivable that the abnormal state be detected if Vαref<Vα4, where Vαref is a predetermined reference development potential within a difference between the maximum of the development bias potential 303 and an electric discharge potential. However, according to the toner adhesion amount control by the middle transfer image detection unit 110, it is impossible to distinguish whether Vα4 becomes greater than Vαref (Vαref<Vα4)

due to the decrease of the development capacity by the environmental fluctuation, which capacity is based on the toner adhesion amount to the development potential difference as shown in FIG. 5, or due to the transfer effectiveness fluctuation as shown in FIG. 6.

Figure 9:
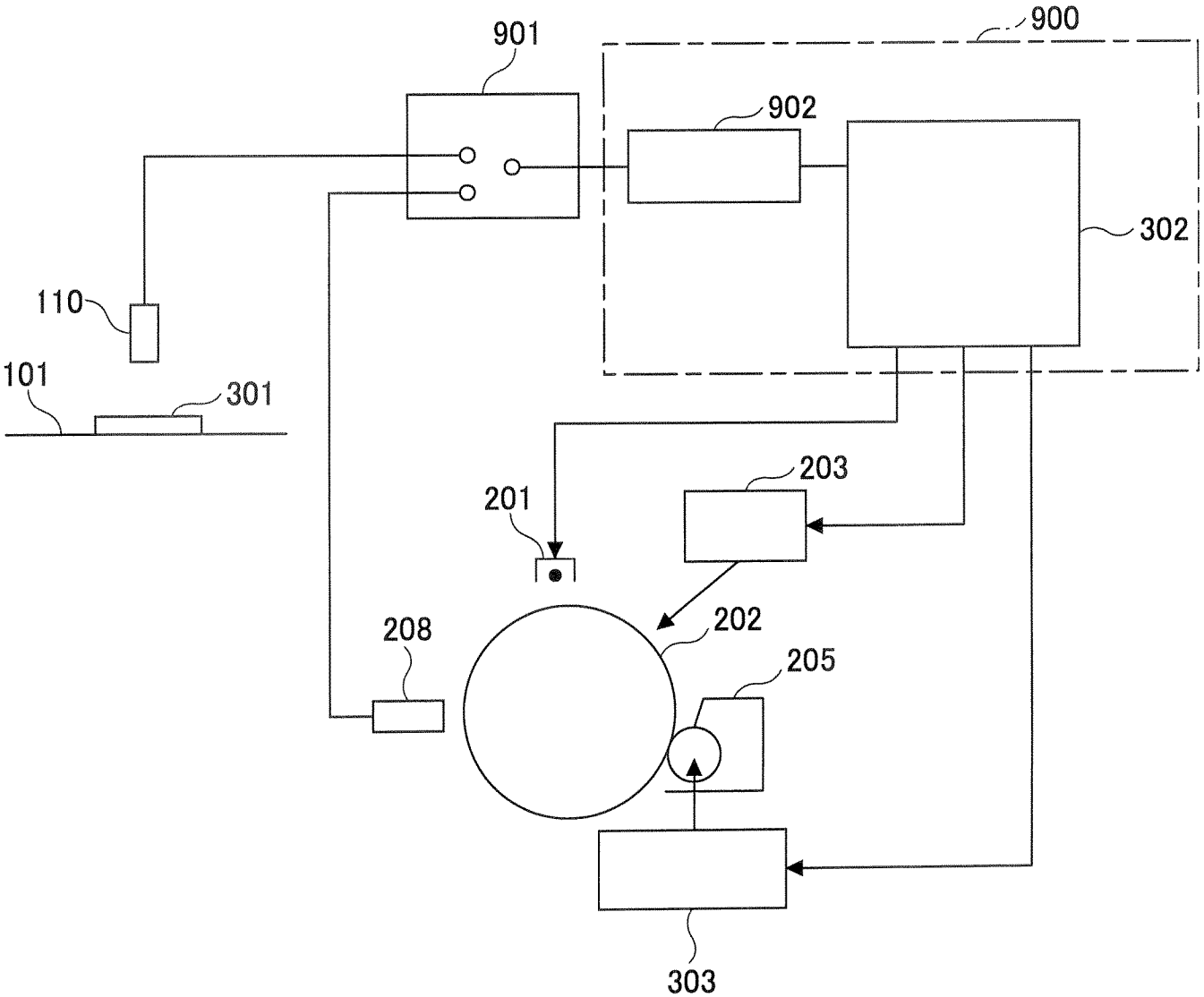
FIG. 9 is a schematic diagram of the second toner adhesion amount control unit.

For this reason, according to the embodiment, a transfer effectiveness detector 900 is provided as shown in FIG. 9. The transfer effectiveness detector 900 includes a computing unit 302 for converting a sensor output voltage into a toner adhesion amount, and a transfer effectiveness detecting unit 902 for detecting an abnormality of the transfer effectiveness, wherein the toner adhesion amount Td on the photo conductor is compared with the toner adhesion amount Tb on the middle transfer object so that the transfer effectiveness may be computed. Here, Td and Tb are obtained by the computing unit 302 converting detection information provided by the photo conductor image detection unit 208 and the middle transfer object image detection unit 110, respectively.

In this way, whether the abnormality is due to the decrease of the development capacity or due to the decrease of the transfer effectiveness can be determined, and a suitable measure can be taken.

Furthermore, according to the present embodiment, the image formation apparatus includes an image detection switching unit 901 for selecting one of the photo conductor image detection unit 208 and the middle transfer object image detection unit 110.

Figure 10:
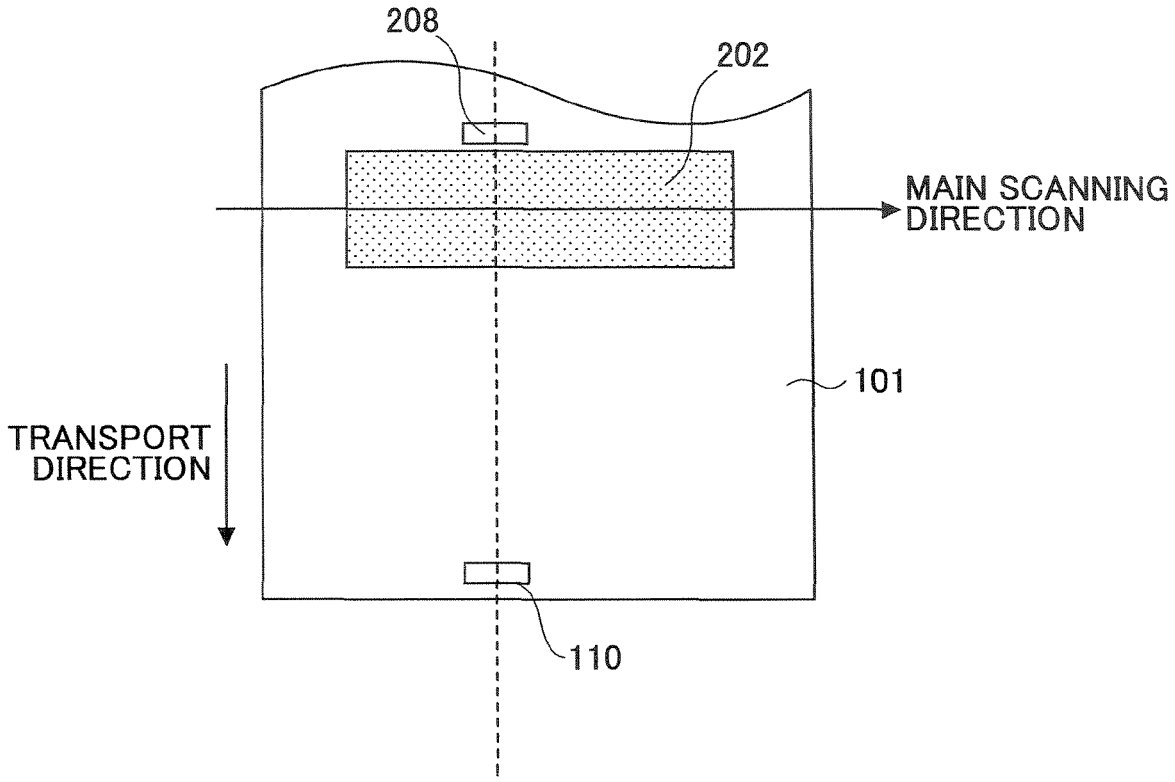
FIG. 10 is a schematic diagram showing installation of the image detection unit.

The photo conductor image detection unit 208 and the middle transfer object image detection unit 110 are arranged at the same location in the main scanning direction as shown in FIG. 10 so that the same density patch 301 is detected in order to accurately acquire the transfer effectiveness.

The transfer effectiveness detector 900 determines that the transfer effectiveness is abnormal if transfer effectiveness γ=(Tb/Td) is below a predetermined threshold value, for example, 70%. Where the transfer effectiveness cannot be compensated for, the image formation apparatus is considered faulty, and the printing operation is stopped.

As described above, according to the embodiment of the present invention, the image formation apparatus detects the transfer effectiveness fluctuation even in an environment where transfer effectiveness is remarkably decreased, and is capable of forming the image with a toner adhesion amount on the photo conductor that is stabilized wherein the toner consumption is reduced.

Hereafter, the range 603, which is the tolerance of the adhesion amount on the photo conductor 202, is described. The relationships between the range 603 and the range 601 (the tolerance of the adhesion amount on Paper S) are described above with reference to FIG. 6.

Figure 8A:
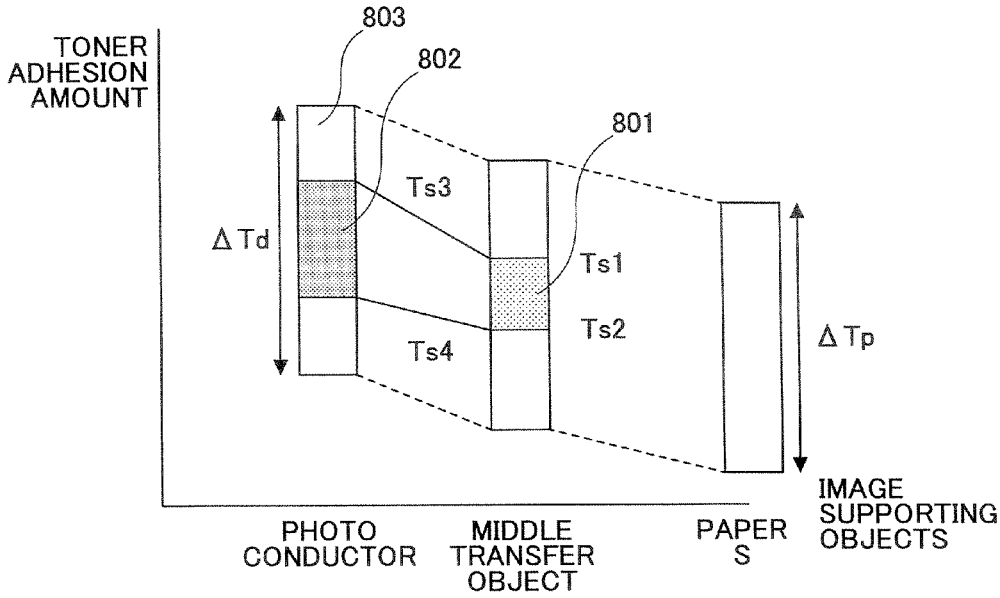
FIG. 8A is a graph showing toner adhesion amounts on the image supporting objects where a patch is detected at the middle transfer belt according to the second toner adhesion amount control.
Figure 8B:
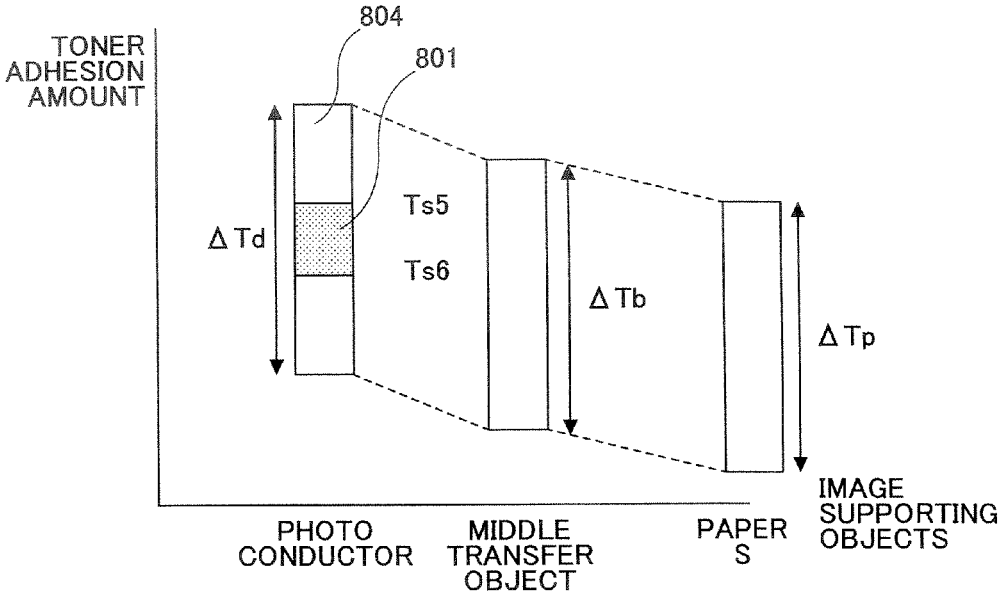
FIG. 8B is a graph showing toner adhesion amounts on the image supporting object where the patch is detected at the photo conductor according to the second toner adhesion amount control.

FIG. 8A and FIG. 8B show relationships between toner adhesion amounts of the density patch 301 formed on the image supporting objects. A detection error 801 is due to the image detection unit. A detection error 802 is the detection error 801 reflected onto the photo conductor error 202 considering the primary transfer effectiveness fluctuation.

A range 803 represents a toner adhesion amount tolerance other than an adhesion amount control error when the density patch 301 is detected at the middle transfer belt 101.

A range 804 represents a toner adhesion amount tolerance other than the adhesion amount control error when the density patch 301 is detected at the photo conductor 202, specifically, adhesion amount fluctuations in axial directions and a circumferential direction of the photo conductor 202. That is, the range 804 is for a sum of toner adhesion amount fluctuations due to such as an installation error of the developing unit 205, roller eccentricity of the photo conductor 202, and a change of adhesion amount during a toner adhesion amount control period.

The case wherein the density patch 301 is detected at the middle transfer belt 101 is described with reference to FIG. 8A.

When the detection error 801 at the middle transfer belt is expressed as ΔTs1=Ts1~Ts2, and the detection error 802 at the photo conductor is expressed as ΔTs2=Ts3~Ts4, relationships between ΔTs1 and ΔTs2, i.e., relationships between Ts1, Ts2, Ts3, and Ts4 are as follows.

$$Ts3=Ts1/\gamma 1MAX$$

$$Ts4=Ts2/\gamma 1min$$

Accordingly, ΔTs2 is greater than ΔTs1 by the factor of the transfer effectiveness.

Next, the case wherein the density patch 301 is detected at the photo conductor 202 is described with reference to FIG. 8B.

When the detection error 801 is detected as ΔTs1=Ts5~Ts6, the detection error 802 at the photo conductor is equal to ΔTs1. This is because it is not necessary to take the transfer effectiveness into consideration.

When detecting the density patch 301 at the middle transfer belt 101, $$\Delta Td = \text{the detection error 802 at the photo conductor} + \text{the toner adhesion amount tolerance 803} = \Delta Ts2 + \text{the toner adhesion amount 803.}$$

When detecting the density patch 301 at the photo conductor 202, $$\Delta Td = \text{the detection error 801} + \text{the toner adhesion amount tolerance 804} = \Delta Ts1 + \text{the toner adhesion amount tolerance 804.}$$

Since Ts2>ΔTs1, the toner adhesion amount tolerance 803<the toner adhesion amount tolerance 804; that is, the tolerance available for the toner adhesion amount fluctuations is greater, which fluctuations are due to such as the installation error of the developing unit 205, the roller eccentricity of the photo conductor 202, and the change of adhesion amount during the toner adhesion amount control period.

That is, for detecting the density patch, the photo conductor image detection unit 208 is used when controlling the image formation conditions, and the middle transfer object image detection unit 110, which is closer to the final image, is used during printing, wherein the detection units are switched by the image detection switching unit 901. In this way, further improvement in stabilization of the images is attained.

As described, according to the embodiment of the present invention, an image formation apparatus that is capable of providing an image that is stabilized is realized by controlling the adhesion amount based on the detection result of the density patch 301 at the photo conductor 202, rather than the detection result of the density patch 301 at the middle transfer belt 101.

Further, the present invention is not limited to these embodiments, but variations and modifications may be made without departing from the scope of the present invention.

The present application is based on Japanese Priority Application No. 2006-201306 filed on Jul. 24, 2006 with the Japanese Patent Office, the entire contents of which are hereby incorporated by reference.

What is claimed is:

1. An image formation apparatus, comprising:

a plurality of image formation units to form toner images in different colors on corresponding image supporting objects;

a middle transfer object, to which the toner images in different colors formed on the image supporting objects of the image formation units are transferred one by one;

an image detection unit that includes a luminous source for irradiating a light to a position where the toner image passes, and an optical receiving unit to receive the light that is reflected by the toner image; and a control unit to control image formation conditions based on a detection result of the image detection unit, wherein the image detection unit includes an image supporting object image detection unit that is arranged countering each of the image supporting objects of the image formation units, and a middle transfer object image detection unit that is arranged countering the middle transfer object;

the image formation unit includes a transfer effectiveness detection unit to detect transfer effectiveness between the image supporting object and the middle transfer object by detecting a difference between a toner adhesion amount of a toner image of a color detected by the image supporting object image detection unit and a toner adhesion amount of the toner image in a same color detected by the middle transfer object image detection unit for all the colors; and the image formation apparatus further comprises an image detection switching unit that selects the image supporting object image detection unit when controlling image formation conditions, and selects the middle transfer object image detection unit during printing.

2. The image formation apparatus as claimed in claim 1, wherein the image supporting object image detection unit and the middle transfer object image detection unit are arranged at the same location in a main scanning direction.

3. The image formation apparatus as claimed in claim 1, wherein a printing operation is stopped when the transfer effectiveness detected by the transfer effectiveness detection unit is different from a target transfer effectiveness.

* * * * *